United States Patent [19]

Hobbs

[11] Patent Number: 4,476,464

[45] Date of Patent: Oct. 9, 1984

[54] ARRANGEMENT FOR REDUCING THE DISPLAY SIZE OF CHARACTERS STORED IN A CHARACTER STORE

[75] Inventor: Donald S. Hobbs, Reigate, England

[73] Assignee: U.S. Philips Corporation, New York, N.Y.

[21] Appl. No.: 359,640

[22] Filed: Mar. 19, 1982

[30] Foreign Application Priority Data

Apr. 10, 1981 [GB] United Kingdom ..... 8111380

[51] Int. Cl.[3] ..... G09G 1/22

[52] U.S. Cl. ..... 340/731; 340/749; 340/750

[58] Field of Search ..... 340/748, 750, 731, 735, 340/749

[56] References Cited

U.S. PATENT DOCUMENTS 4,107,664 8/1978 Marino ..... 340/731

4,284,989 8/1981 Parsons ..... 340/748

4,314,244 2/1982 Demke et al. ..... 340/731

4,357,604 11/1982 Imazeki et al. ..... 340/731

*Primary Examiner*—Gerald L. Brigance

*Attorney, Agent, or Firm*—Thomas A. Briody; William J. Streeter; Edward w. Goodman

[57] ABSTRACT

An alpha-numeric character generator arrangement having a character store (ROM) in which characters are stored in a character format contained within a co-ordinate character matrix of 10×6 discrete character elements. For television interlaced display using a 625-line standard, whole character shapes are displayed in both odd and even fields. For television interlaced display using a 525-line standard, only partial character shapes are displayed in each field, by omitting certain character element rows which are different for each field. The stored character set is so chosen in relation to the omitted character element rows that flicker is minimized. The reduced sized characters, as displayed, allow the same number of rows of characters per frame for the 525-line standard as for the 625-line standard.

7 Claims, 14 Drawing Figures

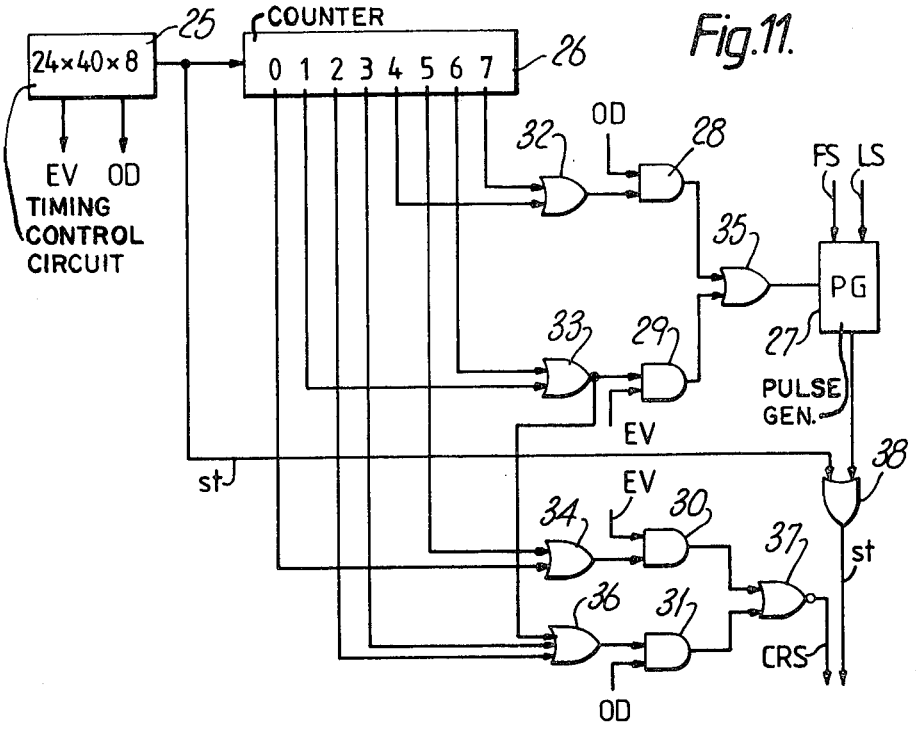
Fig.11.
Fig.12.
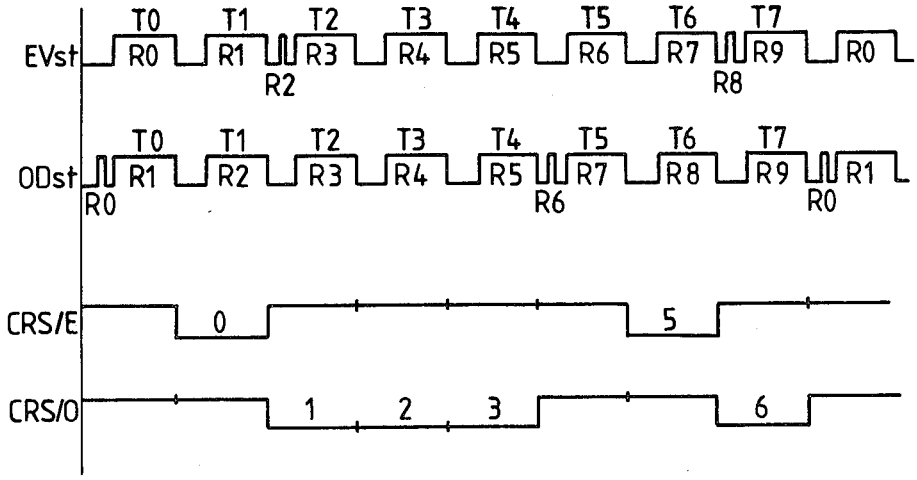

ARRANGEMENT FOR REDUCING THE DISPLAY SIZE OF CHARACTERS STORED IN A CHARACTER STORE

BACKGROUND OF THE INVENTION

The invention relates to alpha-numeric character display by electrical means (e.g. on the screen of a television receiver or using an electrically-operated printer device), and more especially to a character generator arrangement as used in a character display system for producing character generating data for causing the display of characters by the system.

It is known to provide in such a character generator arrangement a character store (e.g. a "read-only" memory device) in which is stored character information pertaining to characters which conform to a character format contained within a co-ordinate matrix of discrete character elements arranged in rows and columns. In response to character input data representing alphanumeric characters selected for display, the character store produces character information which can be used to effect the display.

Such a character generator arrangement can be of a kind which comprises, in addition to the character store, input addressing means for addressing the character store with character input data for a character selected for display, row selection means for producing row addresses each of which is for selecting for a read-out operation from the character store the character information pertaining to a particular character element row of the character matrix, and data output means for producing in said read-out operation the character generating data for the character element(s) in the selected character element row of the selected character.

It is known for a character generator arrangement of the above kind to further comprise logic control means for so controlling the input addressing means and the row selection means as to cause, for a plurality of characters to be displayed as a row of characters, the production of the character generating data for the character elements in a first character element row of each of said plurality of characters in turn, then the production of the character generating data for the character elements in a second character element row thereof in turn, and so on in respect of subsequent character element rows, so that said plurality of characters are built-up together element row-by-element row for display.

For television display (i.e. using raster scanning of a television picture tube), the character generating data is used to modulate the picture tube beam current to selectively brighten-up elemental areas on the television screen to form the displayed characters. The horizontal width of a character displayed in the above manner will be determined by the length of the elemental areas. This horizontal width can be varied without altering the standard line and frame scans for the television picture tube. The vertical height of a display character will be determined by the line spacing of the television screen, so that the character height cannot be varied, using only a single television line for each character element row, unless the television line spacing is varied.

However, it is known to increase the character height (to a conventional display size) by arranging the logic control means to cause the character generator arrangement to produce character generating data appropriate for displaying each row of character elements twice on successive television lines. For non-interlaced raster scanning this involves repeating each row of character elements once in the next successive line scan. For interlaced raster scanning, in which two interlaced fields are used to make up a frame scan, each row of characters is produced in each field, resulting in the interlaced display of characters.

The interlaced raster scanning technique is used inter alia in television receiver apparatus in or for use in a television system of a character in which coded data pulses pertaining to alpha-numeric text or other message information are transmitted in a video signal in at least one television line of television frames where no picture signals pertaining to normal picture information are present. At present, it is envisaged that such transmission would be only in field-blanking intervals, but the possibility does exist for so-called "full-field" transmission in which all the television lines of each field are used for transmitting coded data pulses: in other words an entire television channel is dedicated to the data transmission.

A television system of the above character in which the data transmission is restricted to the field-blanking intervals is described in United Kingdom Patent Specification No. 1,370,535. Television receiver apparatus for the system is known from Mullard Technical Information Article 34, dated Sept. 1976 and Mullard Technical Information Article 54, dated August 1977.

A conventional television receiver for the system includes or has associated with it such television receiver apparatus which comprises a data acquisition circuit to extract the coded data pulses from a received video signal. The extracted coded data pulses are stored in a storage device of the apparatus and after a plurality of frame periods an entity of related message information, for example a page of text, has been received and stored. The television receiver apparatus also includes a character generator arrangement of the kind set forth above for converting the stored message information, as applied to this arrangement as the character input data, into the character generating data which is produced in the form of a video signal to cause the display of the message information at the television receiver.

Examples of a television system of the character referred to are the CEEFAX and ORACLE systems used by the BBC and IBA, respectively, for transmitting Teletext data within the broadcast standards of the 625-line domestic television system as employed in the United Kingdom. The standards laid down for these CEEFAX and ORACLE systems are given in "Broadcast Teletext Specification", Sept. 1976, published jointly by the British Broadcasting Corporation, Independent Broadcasting Authority and British Radio Equipment Manufacturer's Association. These standards specify inter alia that in a page of text there shall be up to 24 rows of characters with up to 40 characters per row. This standard can be achieved in a 625-line television frame by using a character format of $7\times5$ character elements contained within a $10\times6$ character element matrix to cater for the spacing required between adjacent characters in a row and between adjacent rows of characters. Using this character element matrix for the interlaced display of characters therefore requires $24\times10=240$ television lines in each field, so that $240\times2=480$ television lines of a 625-line frame are required to display a page of characters. This number of television lines is well within the maximum number allowed for a visible picture frame, taking into account the use of 50 television lines for the two field blanking intervals per frame, and an overscanning margin of, say 3% in the scanning for the visible picture frame to compensate for small variations in component values or voltages in a television receiver.

Television receiver apparatus which is suitable for Teletext data reception and processing is extremely complex, so that there is an economical advantage in implementing such apparatus in integrated circuit form. However, dedicated integrated circuits which are presently available and are suitable for implementing television receiver apparatus for the 625-line CEEFAX and ORACLE systems, have the limitation that they are unsuitable for implementing television receiver apparatus for Teletext-type data systems which would use another line standard, for instance the 525-line standard which is used widely in the U.S.A.

A particular aspect of such a limitation is that using a character generator arrangement of the kind set forth above which functions to provide the character generating data for 24 rows of character per page of text, it would be possible to display only 20 rows of characters per page of text in a system using the 525-line standard. This is because the 480 television lines which are required for the 24 rows of characters per page of text would not allow a sufficient margin for overscanning, once the television lines which are required for the two field blanking intervals per frame have seen subtracted from the 525-lines per frame which are available. As a result, character rows at the top and bottom of a page, are likely to be outside the visible picture frame. It follows that the entire page format of a Teletext-type data system using a 525-line standard would have to be altered unless the character generator arrangement can be organized to provide character generating data for 24 rows of characters per page of text in a system using a 525-line standard.

SUMMARY OF THE INVENTION

It is an object of the present invention to provide a character generator arrangement of the kind set forth above in which the stored character information of a suitable single character set can be used selectively to provide character generating data appropriate for each character of the set being displayed in at least two different character sizes over different numbers of television lines, so that, per page of text, the maximum number of character rows which can be displayed in a television frame can be the same for television frames of different line standards.

According to the invention a character generator arrangement of the kind set set forth above is characterized in that the row selection means is so controlled in its row selection by logic control means, in respect of each character of a plurality to be displayed as a row of characters on a number of display lines, as to cause the output means to produce character generating data for m successive character element rows of the character to be displayed on m alternate display lines of said number and character generating data for n successive element rows of the character to be displayed on n adjacently intervening display lines of said number, where $n=m$ or $(m\pm1)$, and $m=p-s$ where p is the number of character element rows of the character matrix, and s represents a number of character element rows by which $m<p$. Graphics elements can be displayed in exactly the same way and therefore, for the purposes of the present invention are also to be regarded as (alphanumeric) "characters".

In carrying the invention into effect, character shapes within the character format are preferably so chosen in relation to the omitted character element rows s that each such row contains only a single element or non-adjacent elements along the row. It has been found that with a television display this choice gives the advantage that flicker in displayed characters is less compared with the extent of flicker which would be present with displayed characters for which omitted character element rows contain two or more adjacent elements.

Also, in carrying the invention into effect, the control of the row selection means by the logic control means may be such that the s character element rows omitted from m are different from the s character element rows omitted from n. This control has the advantage that a satisfactory resolution of a displayed character can be more readily obtained with the remaining character element rows.

For simplicity of control by the logic control means the omitted character element rows s, whether or not they are the same in m and n, are preferably the same for all characters of the character set.

As presently envisaged, character generator arrangements according to the invention will have a specific application in providing character generating data for character display in a Teletext-type television data display system using either a 625-line standard or a 525-line standard. As will be described, this specific application affords the advantage that the character generator arrangement can embody an existing form of character store pertaining to a character set which is primarily suited for the interlaced display of 24 rows of characters using 20 television lines for each row in a system using a 625-line standard, and which can be used in combination with a modifying circuit (which modifies the operation of the logic control means) to provide character generating data for the interlaced display also of 24 rows of characters, but using only 16 television lines for each row in a system using a 525-line standard.

For this specific application, in each television field two character element rows of each character are omitted, with the modifying circuit being arranged so that the omitted rows are different in each television field but are the same for all characters of the character set. This has the advantage that only less distinctive features of characters need be omitted so that a satisfactory resolution of the displayed characters can be maintained.

DESCRIPTION OF THE DRAWINGS

In order that the invention may be more fully understood, reference will now be made by way of example to the accompanying drawings, in which:

FIG. 1 is a block diagram of a television system of the character referred to;

FIG. 11 shows a block diagram of a modifying circuit for the logic control unit in the character generator arrangement of FIG. 1;

FIG. 12 shows explanatory waveform diagrams; and

DESCRIPTION OF THE PREFERRED EMBODIMENT

Figure 1:
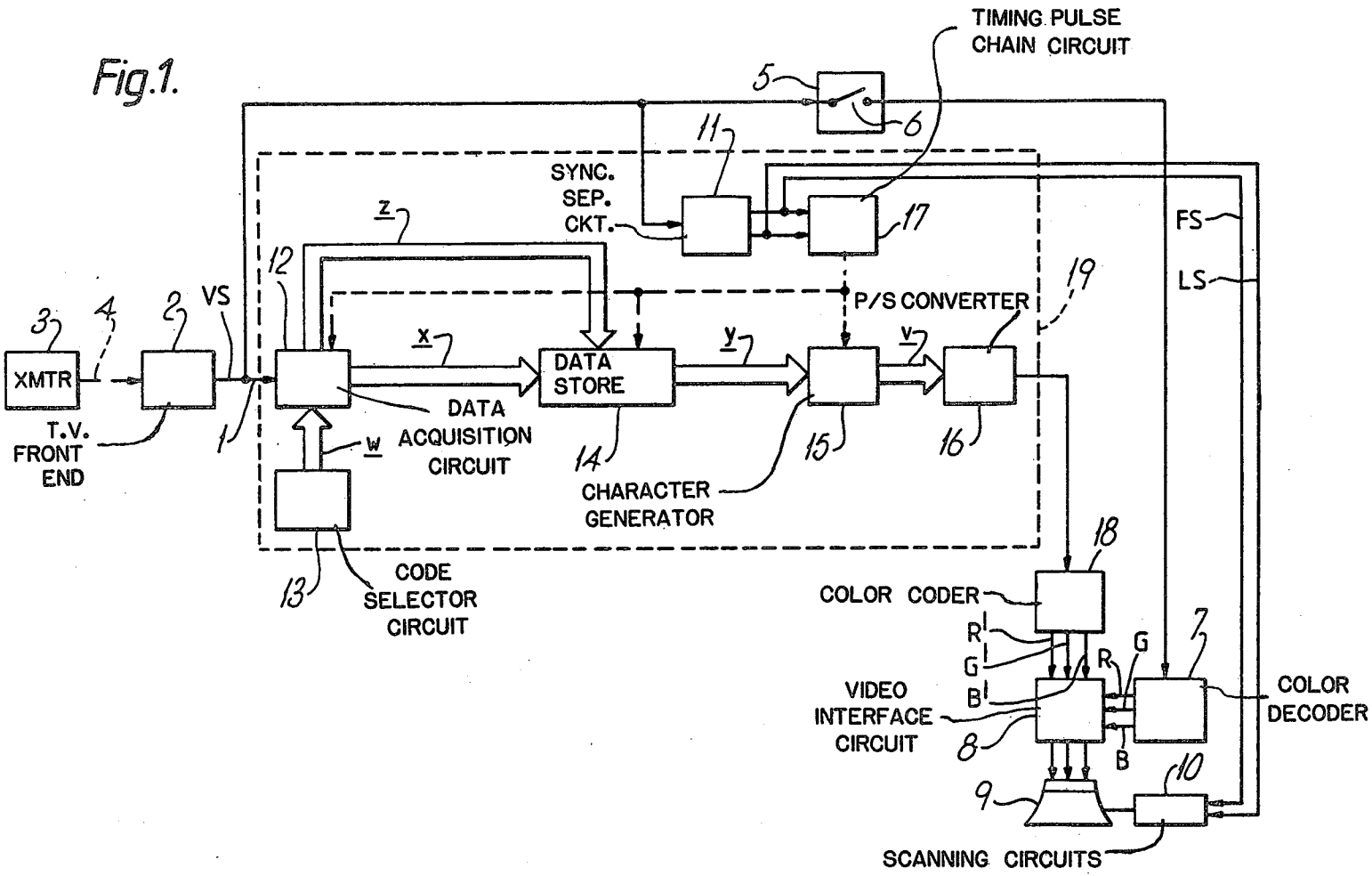

FIG. 1 of the drawings shows diagrammatically a television system of the character referred to having television receiver apparatus which embodies the invention and which is for displaying, selectively, either a television picture which is produced from picture information in a normal broadcast or a cable television video signal, or alpha-numeric text or other message information which is produced from coded pulses which are transmitted in the video signal in vertical or field-blanking intervals thereof. The possibility can also exist for displaying such message information concurrently with a television picture, for instance as sub-titles or captions which are superimposed on the television picture.

Examples of a television system of the character referred to are the aforesaid CEEFAX and ORACLE systems used by the BBC and IBA, respectively, for transmitting Teletext data within the broadcast standards of the 625-line domestic television system as employed in the United Kingdom.

An incoming television video signal VS appears at an input lead 1 of the television receiver apparatus via its front end 2 which comprises the usual amplifying, tuning i.f. and detector circuits. The front end 2 is assumed to be adapted to receive the video signal VS from a television transmitter 3 via a conventional over-air broadcast or cable transmission link 4. The transmitter 3 includes in known manner means for producing television picture information, means for producing alphanumeric text or other message information, and further means for generating the appropriate composite television video signal containing picture signals representative of the picture information, and coded data pulses representative of the message information, together with the usual synchronising, equalizing and blanking signals which are necessary for the operation of the television receiver apparatus.

For normal picture display in the television receiver apparatus, the received video signal is applied to a selector circuit 5 which includes a selector switch 6. When the switch 6 is closed, the video signal VS is applied to a color decoder 7 which produces the R, G and B component signals for the picture display, these component signals being applied via a video interface circuit 8 to the red, green and blue guns of a color television picture tube 9. Scanning circuits 10 for the tube 9 receive the usual line and field synchronizing pulses LS and FS from a synchronizing separator circuit 11 which extracts these synchronizing pulses from the incoming video signal VS.

Coded data pulses representing message information in the video signal VS do not affect the picture display because they occur in one or more lines in the field-blanking interval when there is no picture display. Of the lines occuring in the field-blanking interval, most could be used to transmit coded data pulses representing message information. However, in the BBC/IBA Teletext System at present, only lines 17/18 of even fields and lines 330/331 of odd fields of the 625-line broadcast television system are used in the United Kingdom (See the aforesaid "Broadcast Teletext Specification").

The video signal VS on the input lead 1 is also applied to a data acquisition circuit 12 which includes a data clock pulse generator (not shown) for clocking the coded data pulses representing the message information into the data pulse receiver arrangement of the television receiver apparatus. This data pulse receiver arrangement comprises those elements within the dotted line rectangle 19.

It is assumed that the message information represented by the coded data pulses contained in the video signal VS is divided into different pages of information, and that each page is for display as a whole on the screen of the picture tube 9, with the coded data pulses representing each page of information being repeated periodically in a recurrent cycle with or without updating of the information. It is further assumed that each page of message information is identified by means of a unique page address code which is included in the coded data pulses and defines the page number. The television receiver apparatus includes a code selector circuit 13 which controls the particular coded data pulses that are acquired by the data acquisition circuit 12 at any time. (This control is indicated by a broad-arrow connection w representing the presence of a group of w parallel channels which form an w-bit channel link for carrying w bits of information required for data selection - other groups of parallel channels forming multi-bit channel links in the television receiver apparatus are represented similarly as v, x, y and z numbers of channels and bits).

The acquired coded data pulses are clocked serially into the data acquisition circuit 12 by the clock pulses produced in the latter. From the data acquisition circuit 12, the acquired coded data pulses are fed in parallel groups of x bits to a data store 14. It is assumed that an x-bit character byte is required for each character (or other item of information) contained in the message information. If, for example $x=8$, a character byte would comprise a character code consisting of 7 bits plus a single parity bit. The data store 14 can store a complete page of message information. In the BBC/IBA Teletext system, each page of message contains up to 24 rows of characters, with each row containing up to 40 characters. Thus, in order to identify the different characters of a page, it is furthermore assumed that the coded data pulses also include an address code for each character, this address code employing z bits and being fed to the data store 14 over a z-bit channel link to control the storage therein of the character codes.

In view of the restricted transmission time which is available for transmitting the coded data pulses representing message information, for instance, sufficient time to transmit the coded data pulses for only one character row during a television line in the field-blanking interval, character data for a page of message information has to be stored row-by-row in the data store 14 over a relatively large number of television fields. This storing of character data row-by-row in the data store 14 is under the control of the address codes received from the data acquisition circuit 12 over the z-bit channel link.

A character generator arrangement 15 of the television receiver apparatus is responsive to the character input data applied to it from the data store 14 to produce character generating data which can be used to derive what is effectively a new picture signal for displaying the characters represented by the stored character data. As mentioned previously, different characters are assumed to be represented by respective x-bit bytes. The bits of the character code in each byte are fed in parallel from the data store 14 to the character generator arrangement 15 over a y-bit channel link (y=7). The character format for characters to be displayed is a co-ordinate character matrix composed of discrete elements arranged in rows and columns. This character format is of a special form for the performance of the invention, as will be described. Since the character generating data is required as a modulation of a video signal in order to selectively brighten-up the screen of the picture tube 9 to achieve character display, the character generating data is produced serially (as 1's and 0's) by using a parallel-to-serial converter 16 to convert each row of bits of data read out from the character generator arrangement 15 (e.g. v=5) into serial form.

In order to effect character display on the screen of the picture tube 9 using standard line and frame scans, the logic of the television receiver apparatus in respect of character display is so organized that for each row of characters to be displayed, all the characters of the row are built up television line-by-television line as a whole, and the rows of characters are built up in succession. It takes a number of television lines to build up one row of characters. In the first television line, character data from the data store 14 to the character generator arrangement 15 would cause the latter to produce character generating data in respect of the first row of discrete elements for the first character of the row, then in respect of the first row of discrete elements for the second character, and so on for the successive characters of the row. In the second television line, character generating data in respect of the second row of discrete elements for each character of the row would be produced in turn, and so on for the remaining television lines concerned.

The logic of the television receiver apparatus is organized by means of a timing pulse chain circuit 17 which provides appropriate timing pulses to the data store 14, to the character generator arrangement 15, and to the data acquisition circuit 12. The circuit 17 is synchronized in operation with the scanning circuits 10 of the picture tube 9 by the line and field synchronizing pulses LS and FS extracted from the incoming video signal VS by the synchronizing separator circuit 11.

The output from the converter 16 is applied to a color coder 18 which produces $R^1$, $G^1$ and $B^1$ component signals for character display, these component signals being also applied to the video interface circuits 8. The color coder 18 can be controlled (in a manner not shown) by selected items of the character data in the data store 14 to provide a controlled color character display. Of course, black-and-white picture and character display is also possible, in which event the color decoder 7 and color coder 18 would be omitted.

Figure 2:
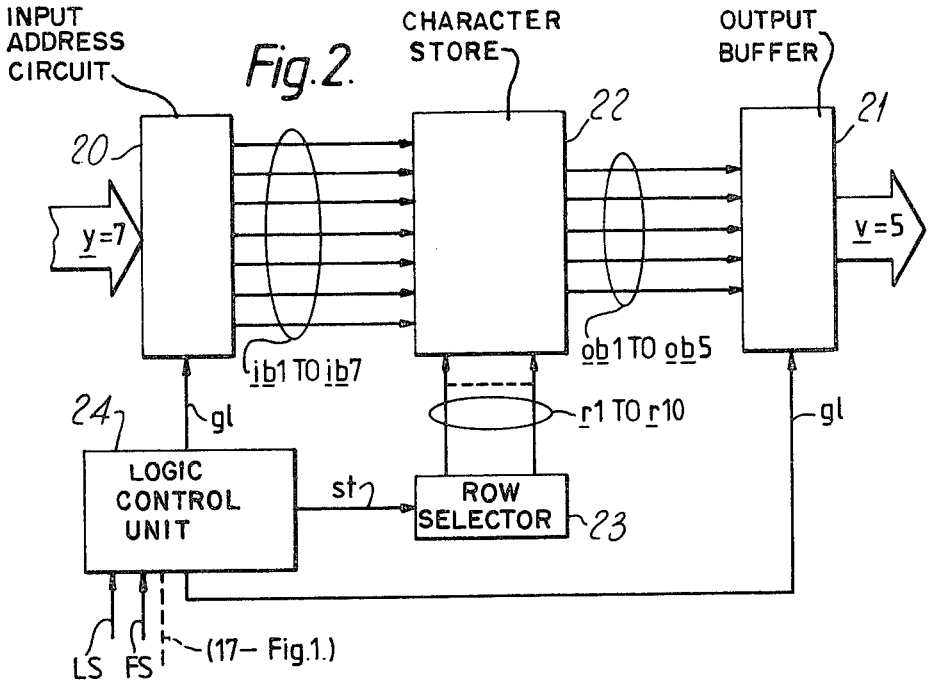
FIG. 2 is a block diagram of a character generator arrangement used in the television receiver apparatus of FIG. 1.

FIG. 2 shows a block diagram of the character generator arrangement 15 used in the television receiver apparatus of FIG. 1. This character generator arrangement comprises an input addressing circuit 20, a gated output buffer 21, a character store 22, a row selector 23, and logic control unit 24. The character store 22 is suitably a "read-only" memory device in which character codes of a character set are stored. The input addressing circuit 20 receives character codes one at a time (from the data store 14-FIG. 1) over the y-bit channel link under the control of the logic control unit 24 which, in turn, has its timing controlled by the timing circuit 17, (FIG. 1). The input addressing circuit 20 comprises a gated buffer for storing each received character code temporarily and addressing the character store 22 with the character code.

This addressing is effected in parallel over 7 addressing lines ib1 to ib7 using binary coding. Thus, up to 128 different characters can be stored in the character store 22 and be identified by a unique 7-bit binary code on the addressing leads ib1 to ib7. The row selector 23 is also operable under the control of the logic control unit 24 to address the character store 22 with row address for selecting character element rows of the character matrix. This row addressing is done on a decimal basis with signals on addressing lines r1 to r10 to select 1-out-of-10 character element rows of the character matrix.

In response to the application thereto of a particular character code and a particular row address signal, the character store 22 produces on a group of 5 output lines ob1 to ob5 a combination of output signals (e.g. a combination of '1's and '0's) corresponding to the combination of character elements and spaces in the selected character element row of a selected character. The output signals on the leads ob1 to ob5 are applied to the gated output buffer 21 for application to the v-bit channel link under the control of the logic control unit 24. The row selector 23 is suitably a counter which has a recurrent count of 10 and which is driven by stepping pulses over a line st from the logic control means 24. The lines gl signify the gating control from the logic control count 24 to the input addressing circuit 20 and the output buffer 21.

Figure 3:
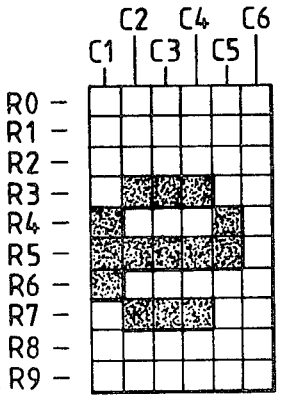
FIGS. 3 to 6 show for the lower case letter e, the character shape, the character code and two display patterns, respectively.
Figure 4:
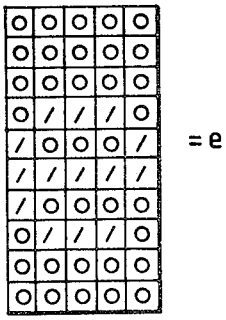

FIG. 3 shows a character shape for the lower case letter e using a character format of 7×5 character elements contained within a 10×6 character element matrix comprising 10 rows RO to R9 and 6 columns C1 to C6. (Since the column C6 is required solely to provide a space between adjacent characters, as displayed, this column will not be considered further or shown hereinafter in relation to other character shapes of a character set which is suitable for the purpose of the invention). The corresponding character code for the lower case letter e as stored in the character store 22 is shown in FIG. 4. For addressing purposes, it is usually more convenient, but not essential, for the elements of a stored character to be stored in the same relative positions as they occupy in the character shape and this positioning has been assumed in FIG. 4. Thus, if in the character generator arrangement of FIG. 2, row R3 of the lower case letter e had been selected, the output signal combination on the leads ob1 to ob5 would be 01110.

Figure 6:
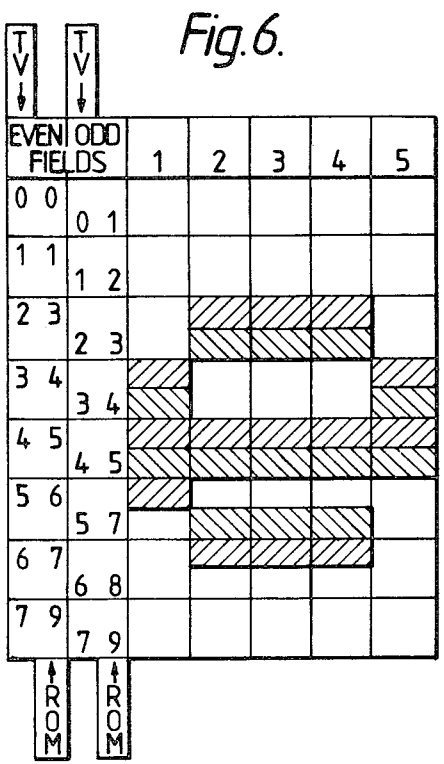
Figure 5:
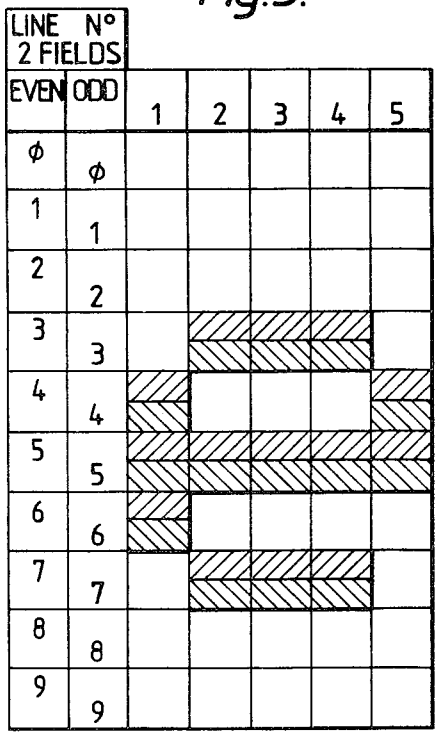

Considering now the display on a television screen of the lower case letter e in the two ways illustrated in FIGS. 5 and 6, in which the hatched elements represent bright-up of the television screen. The display pattern illustrated in FIG. 5 is conventional and is achieved using an interlaced display of even and odd fields in each of which 10 television lines EØ to E9 and OØ to O9 are used to display the whole of the stored character shape. The display pattern illustrated in FIG. 6 is not conventional and is achieved using an interlaced display of even and odd fields in each of which only 8 television lines EØ to E7 and OØ to O7 are used to display part of the stored character shape for the even field and a different part of the character shape for the odd field. In the display pattern of FIG. 5, the character element row numbers Ø to 9 of the character matrix correspond to the television line numbers. In the display pattern of FIG. 6, the character element rows 2 and 8 have been omitted for the even field pattern and the character element rows 0 and 6 has been omitted for the odd field pattern.

Figure 7:
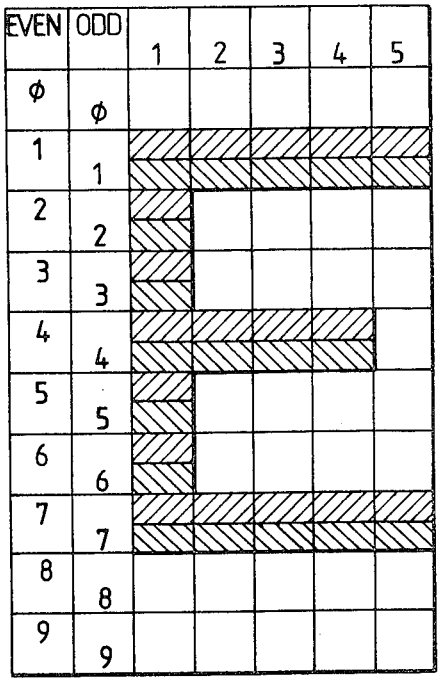
FIGS. 7 and 8 show two display patterns for the upper case letter E.
Figure 8:
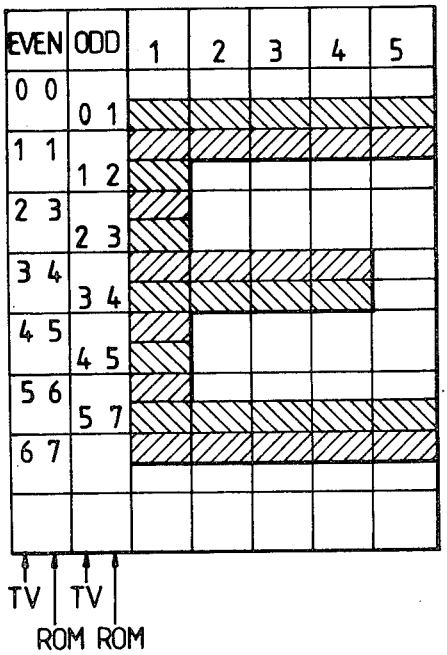

Another example of two display patterns for the same character is illustrated in FIGS. 7 and 8 for the upper case letter E. The display pattern of FIG. 7 is formed using the whole of the stored character shape in a 20 television line interlaced display and the display pattern of FIG. 8 is formed using only part of the stored character shape in a 16 television line interlaced display. In FIG. 8, the character element rows 2 and 8 have been omitted for the even field pattern and the character element rows 0 and 6 have been omitted for the odd field pattern, as in FIG. 6.

The (full) display patterns illustrated in FIGS. 5 and 7 are suitable for 625-line television rasters with a 50 Hz field rate, for which it has been found that the even and odd field display patterns should be kept substantially the same to avoid flicker effects. The (partial) display patterns illustrated in FIGS. 6 and 8 are suitable for 525-line television rasters with a 60 Hz field rate, for which it has been found that different even and odd field display patterns can be used to produce an overall acceptable display pattern without incurring unacceptable flicker problems. However, flicker at the 60 Hz field rate can be reduced further by avoiding (as far as possible) in the overall display pattern unrepeated character element rows which contain two or more adjacent elements.

Figure 9:
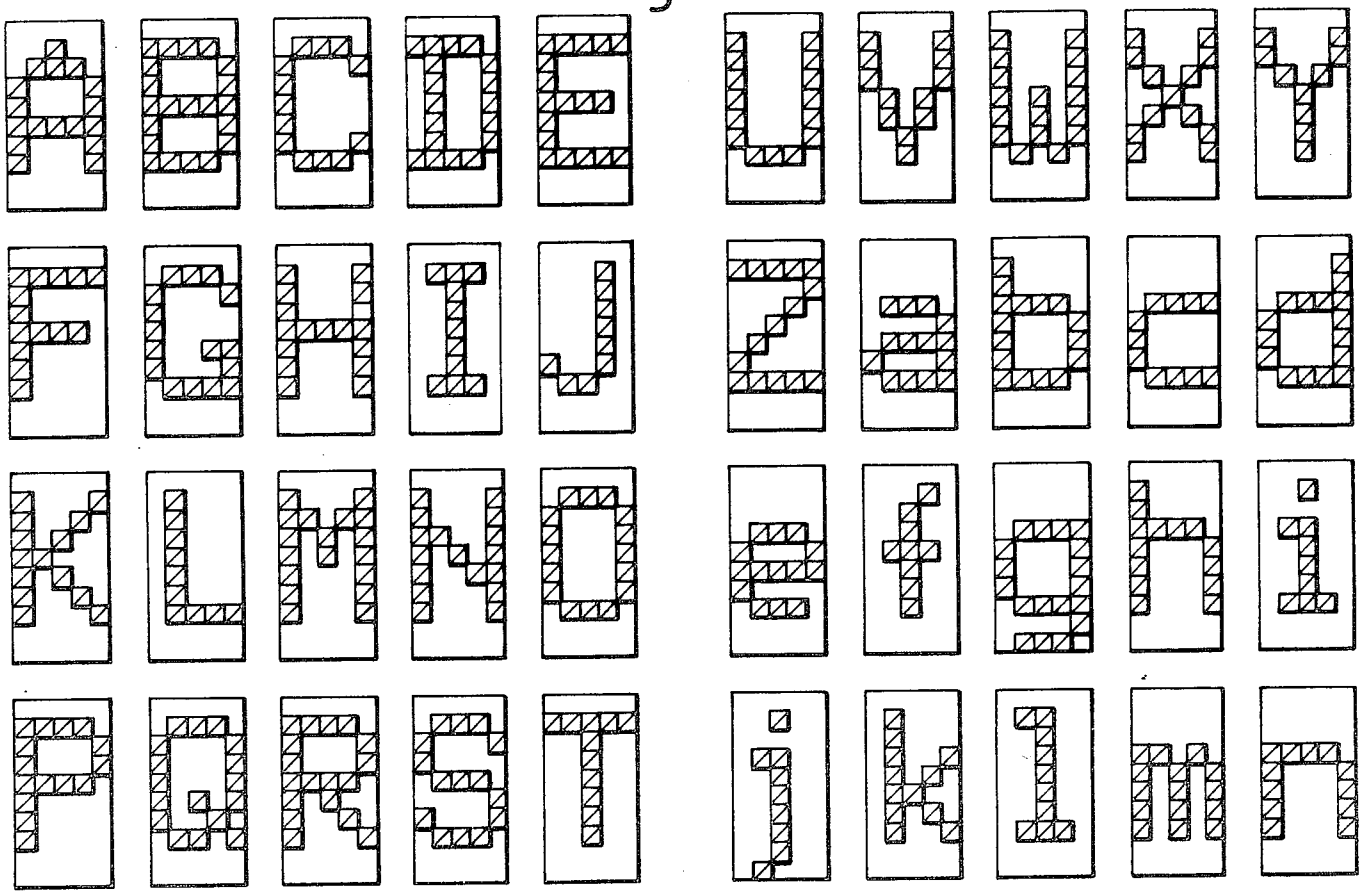
FIGS. 9 and 10 show a character set which is suitable for the purposes of the invention.
Figure 10:
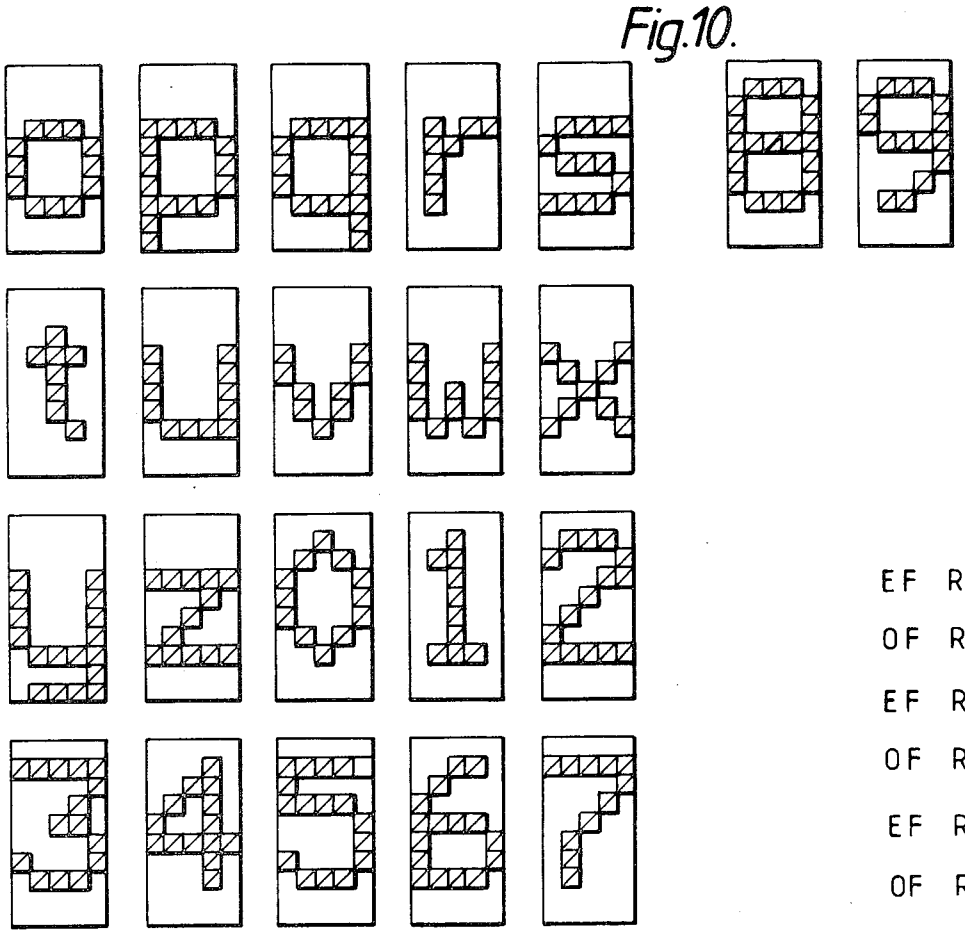

The character set shown in FIGS. 9 and 10 is suitable in the above respects for the purposes of the invention.

The modifying circuit shown in FIG. 11 forms part of the logic control unit 24 (FIG. 2) and is driven by a timing control circuit 25 of the unit 24. The modifying circuit comprises a counter 26 having a cyclic count of 8, a pulse generator 27, AND-gates 28 to 31 and OR-gates 32 to 38. The timing control circuit 25 produces stepping pulses on the lead st for driving the row selector (23 - FIG. 2) in a manner appropriate for the interlaced display on a television screen of 24 rows of characters over 16 television lines, with up to 40 characters per row. These stepping pulses can be considered as line signals as they occur once per television line for each field. Such a display would relate to a television system having a 525-line standard as discussed previously, for which the timing control for the system described with reference to FIG. 1 could be readily adapted in known manner. The timing control circuit 25 also applies the stepping pulses on the lead st to the counter 26 which produces output signals successively at its outputs 0 to 7 in response to the stepping pulses. The output signals at output 4 and 7 are applied through the OR-gate 32 to the AND-gate 28, and the output signals at the outputs 1 and 6 are applied through the OR-gate 33 to the AND-gate 29. The timing control circuit 25 also produces EVEN and ODD field signals EV and OD for the duration of the relevant field and these signals are applied respectively to the AND-gates 29 and 28 at second inputs thereof. Thus, during even fields, line signals 1 and 6 in each group of eight are applied through the OR-gate 35 to the pulse generator 27, and during odd fields, line signals 4 and 7 in each group of eight are applied through the OR-gate 35 to the pulse generator 27. The pulse generator 27 also has applied to it the line and field synchronising pulses LS and FS and is responsive during the line flyback period following the application to it of the output signal from the OR-gate 35 of a "jump" pulse of short duration which is added in with the stepping pulses on the lead st through the OR-gate 38. The effect of the "jump" pulses is to increase the number of row selection pulses applied to the row selector 23 from 8 to 10 in each eight line group, but without the character element rows corresponding to the "jump" pulses being read-out from the character store (22 - FIG. 2).

In FIG. 12, the stepping pulse train for the eight line group in even fields is represented by the pulse waveform EVst, and the stepping pulse train for the eight line group in odd fields is represented by the pulse waveform OD. In each of the pulse waveforms EVst and ODst the numbers TO to T7 above the individual pulses identify the television line numbers of the eight line group, whereas the numbers within each of the individual pulses identify the character element rows of the character matrix which are actually displayed on the television lines concerned. Thus, for the pulse waveform EVst the character element rows R0, R1, R3, R4 R5, R6, R7 and R9 correspond, respectively, to the television line pulses T0 to T7, whereas for the pulse waveform ODst the character element rows R1, R2, R3, R4, R5, R7, R8 and R9 correspond, respectively, to the television line pulses T0 to T7. In the waveform EVst the "jump" pulses E1 and E6 omit the character element rows R2 and R8, respectively. In the waveform ODst the two "jump" pulses 07 and 04 omit the character element rows R0 and R6, respectively.

Consideration of 20 and 16 television line character displays of the upper case letter E as illustrated in FIGS. 7 and 8 will show that certain of the repeated character element rows of the letter E in FIG. 8 are in the reverse order, i.e. odd then even field television line, relative to the corresponding rows of the letter E in FIG. 7.

Figure 13:
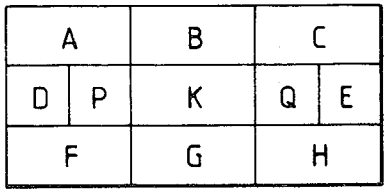
FIGS. 13 and 14 illustrate a so-called character rounding technique which is taken into account in the performance of the invention.

In particular, the repeated character element rows 1, 1, and 7, 7 are displayed in the reverse order in FIG. 8, whereas the repeated character element rows 3,3; 4,4; 5,5 and 9,9 are displayed without reversal. The character element rows 0, 2, 6 and 8 are displayed only once. The reversal of the repeated character element rows 1,1 and 7,7 requires a modification of the well-known character rounding technique as used in character display to be taken into account. This character rounding technique may be explained briefly, as follows, with reference to FIGS. 13 and 14. As each character element is selected for display it is assumed to occupy the central position K (FIG. 13) of the 3 ×3 segment and on the basis of the occupancy of the other character element positions of the segment a decision is made whether or not to insert a half width character in one or each adjacent position of the same character element row. The Boolean logic for these decisions is as follows, for which A,B,C,F,G and H identify the respective character element positions which they occupy, D and E identify the full character element positions on each side of the considered position K, and P and Q identify the half width character element positions on each side of the considered position K. Thus the condition for the display of a half width character in position P is 7.4.81

$$P = [K.\ B.\ \overline{G}.\ \overline{D}.\ \overline{E}.\ F]$$

-continued or $$P = [K.\ \bar{B}.\ G.\ \bar{D}.\ \bar{E}.\ A]$$

The condition for the display of a half width character in position Q is $$Q = [K.\ B.\ \bar{G}.\ \bar{D}.\ \bar{E}.\ H]$$

or $$Q = [K.\ \bar{B}.\ G.\ \bar{D}.\ \bar{E}.\ C]$$

Figure 14:
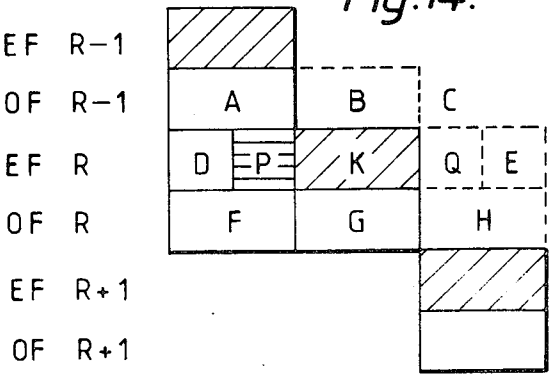

For an even field, a character element in position K is in character element row R of the even field character pattern so that elements for positions ABC are in row (R−1) of the odd field character pattern, and elements for positions FGH are in row R of the odd field character pattern. For an odd field a character element in position K is in row R of the odd field character pattern so that elements for position ABC are in row R of the even field character pattern and elements for positions FGH are in row R+1 of the even field character pattern. FIG. 14 shows an example of this character element allocation and also the display of the half width character element in position P. In FIG. 14, EF represents the even field and OF the odd field adjacent the relevent character element row R, (R−1) and (R+1), as the case may be.

In the modifying circuit of FIG. 11, an output lead CRS provides a suitably corrected character rounding signal. For character rounding in an even field for a fully repeated display as in FIG. 7, a character rounding signal would be at a high level, say, to signify that character rounding is to be in respect of the preceding character element row which is a different row, and for character rounding in an odd field the character rounding signal would be at a low level to signify that character rounding is to be in respect of the succeeding character element row which is also a different row. The corrected character rounding signal provided by the modifying circuit of FIG. 11, reverses these high and low signal levels for certain television lines of the eight line group in both even and odd fields to take into account the reversal of the display order of the character element rows 1,1 and 7,7. For even fields, the character rounding signal CRS/E is produced and for odd fields the character rounding signal CRS/O is produced, as shown in FIG. 12. In FIG. 11, OR-gate 34 and AND-gate 30 feed the OR-gate 37 to provide the signal CRS in even fields, and OR-gate 36 and AND-gate 31 to feed the OR-gate 37 to provide the signal CRS in odd fields.

During the line flyback period when the "jump" pulses are being applied to the row selector, visible interference due to the character element rows which are briefly scanned in this period can be avoided by causing the timing control circuit 25 to produce a blanking waveform (not shown) which inhibits the production of the character generating data in the line flyback period.

I claim:

1. A character generator arrangement for use in a character display system for producing character generating data for causing the display of characters by the system; which arrangement comprises a character store in which is stored information pertaining to characters which conform to a format contained within a co-ordinate matrix of discrete character elements arranged in rows and columns, input addressing means for addressing the character store with input data for a character selected for display, row selection means for producing row addresses each of which is for selecting, for a read-out operation from the character store, the information pertaining to a particular character element row of the matrix, and data output means for producing in said read-out operation character generating data for the character element(s) in the selected character element row of the selected character; characterized in that said arrangement further comprises logic control means for controlling the row selection means in its row selection, in respect of each of a plurality of characters to be displayed as a row of characters on a number of display lines, such that the output means produces character generating data for m successive element rows of the character to be displayed on m alternate display lines of said number of display lines, and character generating data for n successive character element rows of the character to be displayed on n adjacently intervening display lines of said number of display lines, where n=m or (m±1), n=p−t and m=p−s, where p is the number of character element rows of the character matrix, and s and t, respectively and where the character shapes within the character format are so chosen in relation to the omitted character element rows s and t that each such omitted row would contain only a single element or non-adjacent elements along the row, represent numbers of character element rows to be omitted by which m<p and n<p, respectively.

2. A character generator arrangement as claimed in claim 1 characterized in that the control of the row selection means by the logic control means is such that the s character element rows omitted from m are different from the t character element rows omitted from n.

3. A character generator arrangement as claimed in claim 1, characterized in that the control of the row selection means by the logic control means is such that omitted character element rows s and t, are the same for all characters of the character set.

4. A character generator arrangement as claimed in claim 1, characterized in that the control of the row selection means by the logic control means is such that the arrangement is alternately operable to produce character generating data for the condition where m=n=p.

5. A character generator arrangement as claimed in claim 1, characterized in that the control of the row selection means and the input addressing means by the logic control means is such as to cause, for a plurality of characters to be displayed as a row of characters, the production by the output means of the character generating data for the character elements in a first character element row of each of said plurality of characters in turn, then the production of the character generating data for the character elements in a second character element row thereof in turn, and so on in respect of subsequent character element rows, so that said plurality of characters are built-up together element row-by-element row for display.

6. A character generator arrangement as claimed in claim 1, characterized in that said output means produces the character generating data in a form appropriate for television picture tube display for modulating the picture tube beam current to selectively brighten-up elemental areas on the screen of the picture tube to form the display characters.

7. A character generator arrangement as claimed in claim 5 or claim 6, characterized in that said arrangement provides character generating data for a television display system using either a 625-line standard or a 525-line standard, the character store of the arrangement containing character information for a character set which is suited either for the interlaced display of 24 rows of characters using 20 television lines for each row in a system using a 625-line standard, or for the interlaced display of 24 rows of characters using 16 television lines for each row in a system using a 525-line standard, the latter display involving the selective omission in respect of each character as displayed of two character element rows in each field, the omitted rows being different in each field, but the same for all the characters of the set.

* * * * *

UNITED STATES PATENT AND TRADEMARK OFFICE

CERTIFICATE OF CORRECTION

PATENT NO. : 4,476,464

DATED : October 9, 1984

INVENTOR(S) : DONALD S. HOBBS

It is certified that error appears in the above-identified patent and that said Letters Patent is hereby corrected as shown below:

Column 12, line 23, after "respectively" insert --represent numbers of character element rows to be omitted by which m<p and n<p, respectively,--

Column 12, line 27, delete "repre-"

Column 12, lines 28 and 29 delete intheir entirety.

Signed and Sealed this

Fourth Day of June 1985

[SEAL]

*Attest:*

DONALD J. QUIGG

*Attesting Officer* *Acting Commissioner of Patents and Trademarks*